US008162364B2

(12) United States Patent
Boselli et al.

(10) Patent No.: US 8,162,364 B2
(45) Date of Patent: Apr. 24, 2012

(54) HOOKING DEVICE FOR MOVING SYSTEMS OF ROLLING CYLINDERS

(75) Inventors: Giovanni Boselli, Magenta (IT); Marco Cozzi, Marnate (IT); Erasmo Trenti, Castellanza (IT); Riccardo Geroli, Paderno Dugnano (IT)

(73) Assignee: Tenova S.p.A., Milan (IT)

( * ) Notice: Subject to any disclaimer, the term of this patent is extended or adjusted under 35 U.S.C. 154(b) by 341 days.

(21) Appl. No.: 12/374,864

(22) PCT Filed: Jul. 25, 2007

(86) PCT No.: PCT/IB2007/002219

§ 371 (c)(1),
(2), (4) Date: Mar. 11, 2009

(87) PCT Pub. No.: WO2008/012677

PCT Pub. Date: Jan. 31, 2008

(65) Prior Publication Data

US 2010/0019519 A1 Jan. 28, 2010

(30) Foreign Application Priority Data

Jul. 26, 2006 (IT) ..... MI2006A1460

(51) Int. Cl.
*B66C 1/10* (2006.01)

(52) U.S. Cl. ..... 294/81.3; 294/67.5; 294/905; 294/907

(58) Field of Classification Search ..... 294/81.3, 294/68.3, 67.21, 67.5, 905, 907
See application file for complete search history.

(56) References Cited

U.S. PATENT DOCUMENTS

| | | | | |
|---|---|---|---|---|
| 2,246,142 | A * | 6/1941 | Moore | 294/67.21 |
| 2,703,252 | A * | 3/1955 | Blackwell | 294/67.5 |
| 4,017,109 | A * | 4/1977 | Belinsky | 294/67.21 |
| 4,090,388 | A | 5/1978 | Pim | |
| 4,451,198 | A * | 5/1984 | Sanderson | 414/779 |
| 4,626,012 | A * | 12/1986 | Weldele | 294/81.3 |
| 4,759,674 | A * | 7/1988 | Schroder et al. | 414/146 |
| 4,770,021 | A | 9/1988 | Kobayashi et al. | |
| 4,936,616 | A * | 6/1990 | Williams | 294/81.3 |
| 4,973,094 | A * | 11/1990 | Tana et al. | 294/81.21 |
| 6,048,012 | A * | 4/2000 | Selby et al. | 294/81.3 |
| 2006/0144115 | A1 | 7/2006 | Mark et al. | |

FOREIGN PATENT DOCUMENTS

| | | |
|---|---|---|
| EP | 0 239 004 | 9/1987 |
| EP | 1 676 653 | 7/2006 |
| JP | 62 124005 | 6/1987 |

* cited by examiner

*Primary Examiner* — Dean Kramer
(74) *Attorney, Agent, or Firm* — Oblon, Spivak, McClelland, Maier & Neustadt, L.L.P.

(57) ABSTRACT

A hooking device for moving systems of rolling cylinders includes a load-bearing lifting structure of a cylinder provided with a gripping structure and an upper hooking structure suitable for keeping the device in a raised position. The device also includes a non- load bearing tilt compensation structure. The tilt compensation structure includes a series of guides, where each guide is provided with at least one mass element. The at least one mass element is moveable along the guide.

16 Claims, 5 Drawing Sheets

Background

HOOKING DEVICE FOR MOVING SYSTEMS OF ROLLING CYLINDERS

The present invention relates to a hooking device for moving systems of rolling cylinders.

So-called "Roll Shops" are areas of steelworks dedicated to the reconditioning of worn rolls or cylinders, used in rolling cages.

The processings on these cylinders are determined by the specific quality maintenance requests of the laminate produced, and also on their weight and relative cost.

In order to avoid marking the product, thus reducing its quality and consequently the sales price, the surfaces must be frequently refaced with extremely limited form tolerances.

Taking advantage of the refacing operations, a whole series of "Non-Destructive Controls" (NDC) is effected, which identify the number and extension of defects, in this way also defining the cycle for their reconditioning.

These cylinders are present in different variants which differ mainly in the dimensions and forms, whereas they are alike in their high weights and high investment costs.

The rapidity with which the reprocessing operations are carried out influences the number of cylinders necessary in a rolling line and consequently also the overall investment of the line itself.

The current tendency in Roll Shops therefore implies an increasingly forced automation. The fundamental point in embodying this policy consists in providing Roll Shops with a moving system of the cylinders which is as elastic as possible, efficient and rapid in spite of the masses involved and particularly reduced positioning tolerances.

Moving operations in Roll Shops are normally effected with hooking devices of the cylinder called "balances". These are structures equipped with grippers and sustained by cables of the gantry crane of the building containing the Roll Shops. Their function is to effect certain preliminary preparatory operations for the reprocessing among which, for example, the overturning of voluminous and asymmetrical anchoring devices to the rolling cage, protruding with respect to the surface of the cylinder called "trimmers", positioning them so that they do not obstruct the refacing operations.

The evaluation of the operative quality of a balance, in addition to its initial investment and maintenance, is based on the moving activation rate, i.e. on the necessary loading time, the re-configuration and deposit in situ of the cylinder as well as on the positioning accuracy.

The most rudimental moving systems are influenced by the asymmetry in the weight distribution of the cylinders. The centre of gravity, in fact, rarely coincides with the centre line of the system: at the moment of lifting there are therefore pitching oscillations also caused by the limited constraint induced by the supporting cables, which must be damped before redepositing on the specific machine, such as a grinding machine.

These systems, moreover, are subject to unbalancing and the consequent tilting of the cylinder which influence its safety and depositing velocity.

Furthermore, the rotation operation of the "trimmings" causes side veering creating oscillations and therefore uncertainty in the positioning, reducing the accuracy of the moving operation and prolonging the times.

In order to at least partially solve the problems described above, hooking devices already used in moving systems are known—such as for example those illustrated in FIG. 1—which comprise translation means 10, 11 of a hook which allows an overall moving of the structure 30, 31, 32, 33 of the cylinder-holder 50 and trimmings 55 in the pitching direction alone, thus following the barycentre and in this way annulling any tilting due to this type of axial unbalancing.

This solution however is not of great commercial interest as it has various disadvantages among which a considerable mechanical complication induced by the necessity of translating the whole weight structure which is quite significant, with shifting of the centre of gravity which must be effected at a rate compatible with the overall moving time.

Furthermore, the translation of the hooking point, in turn, induces oscillations which are added to those already naturally generated by the lifting operation, as the supporting system to the gantry crane is achieved with cables and is consequently not at all rigid.

These oscillations cannot be easily dealt with by an automated system and often only the experience, competence and skill of the machine operator can reduce the time necessary for completing the operation at acceptable levels.

In addition, as the translation of the attachment point varies from cylinder to cylinder, it induces great uncertainty as to the real position of the ends to be hooked to the grinding machine, jeopardizing the overall accuracy of the system and the possibility of exonerating a human operator assisting the operation, unless cumbersome and invasive guides and/or mechanical centering systems are introduced.

The balances currently on the market, moreover, completely lack the possibility of transversal regulation.

This regulation is necessary as the trimmings are heavy and substantially parallelepiped-shaped elements which are rotated around an axis far from their centre of gravity. These rotations cause rolling which, although to a lesser extent with respect to the pitching, takes place in a direction with a low inertia moment and is therefore more marked.

In addition, the fact of having to operate orthogonally to the translation direction makes any attempt at reducing its intensity more complicated with consequent time losses.

The machine operator, moreover, has no means of interfering with these oscillations except for operating with the positioning of the gantry crane itself.

Finally it should be noted that the power installed for compensating the tilting depends on the mass to be moved and the tilt angle reached.

For strong attachment angles which must in any case be considered in the design phase, the system must be capable of moving a consistent fraction of the overall weight of the structure comprising the cylinder and balance.

In the case of known balances, the introduction of translation means of the whole structure causes a deterioration in the dimensioning of the motors and the whole moving mechanics and consequently a considerable increase in the costs.

A general objective of the present invention is to overcome the drawbacks described above of the known art in an extremely simple, economical and particularly functional manner.

A further objective is to conceive a hooking device for moving systems of rolling cylinders which is capable of effecting a correction of both the tilt angles, also damping possible pitching oscillations and/or transversal rolling.

Another objective of the present invention is to provide a hooking device for moving systems of rolling cylinders which has a simple structure and allows the above tiltings to be rapidly and economically compensated.

Yet another objective of the present invention is to provide a hooking device for moving systems of rolling cylinders which has a high precision allowing it to be both manually and automatically piloted inside the Roll Shop.

In view of the above objectives, according to the present invention, a hooking device for moving systems of rolling cylinders has been conceived, having the characteristics specified in the enclosed claims.

The structural and functional characteristics of the present invention and its advantages with respect to the known art will appear more evident from the following description, referring to the enclosed drawings, which show a hooking device for moving systems of rolling cylinders produced according to the innovative principles of the invention itself.

Figure 2:
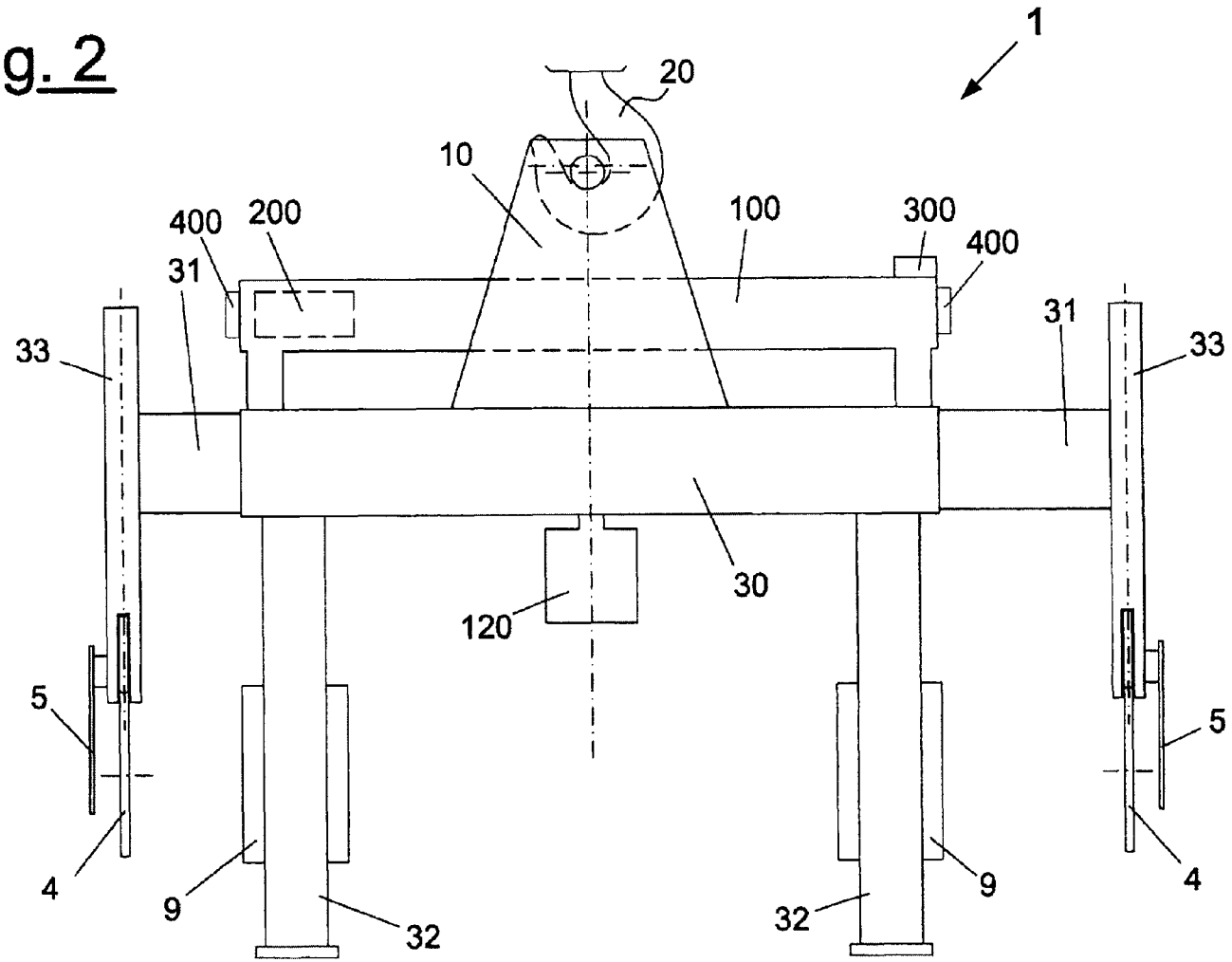
FIG. 2 shows a longitudinal side view of a hooking device for moving systems of rolling cylinders according to the present invention in an unloaded condition.
Figure 2A:
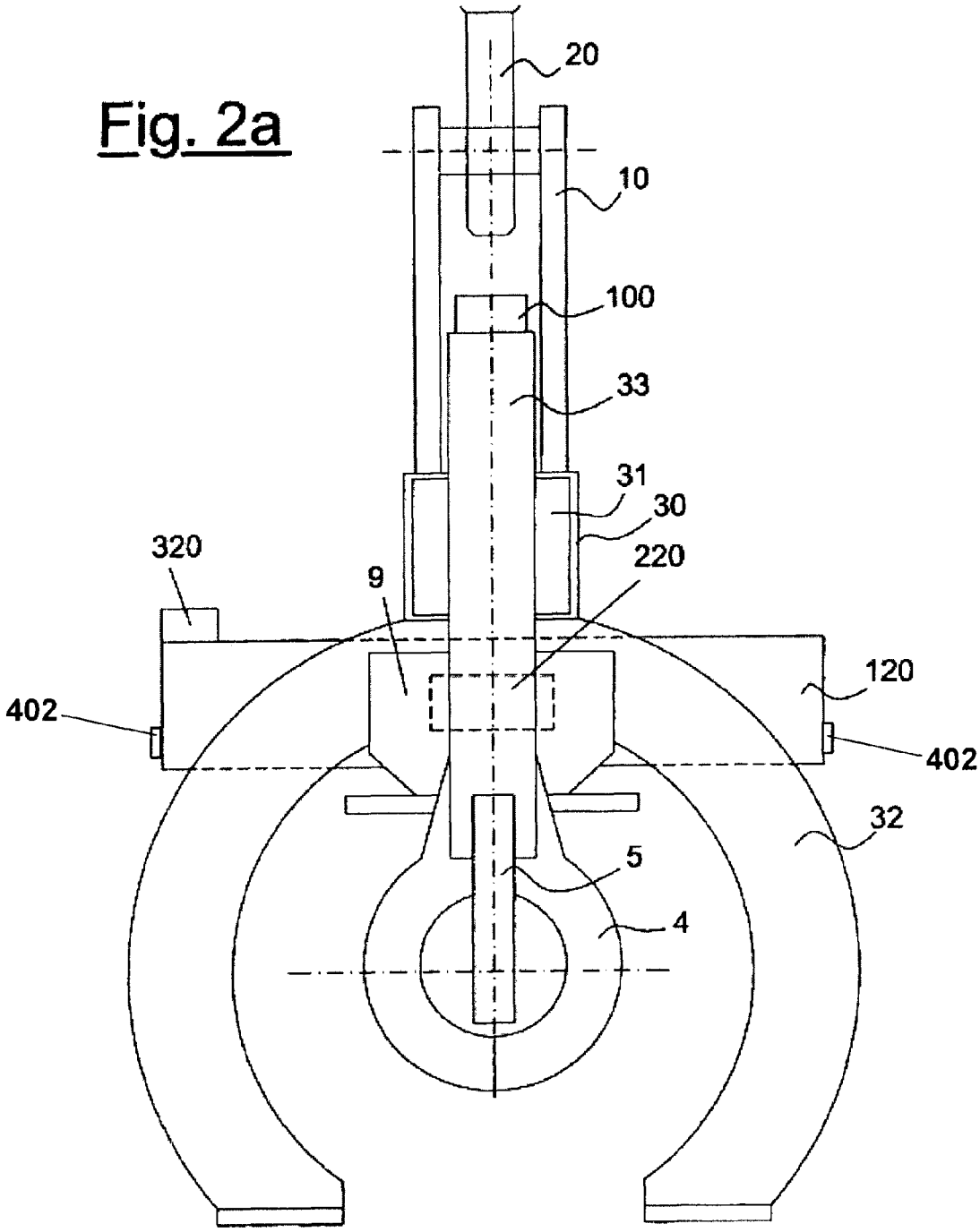
Figure 3:
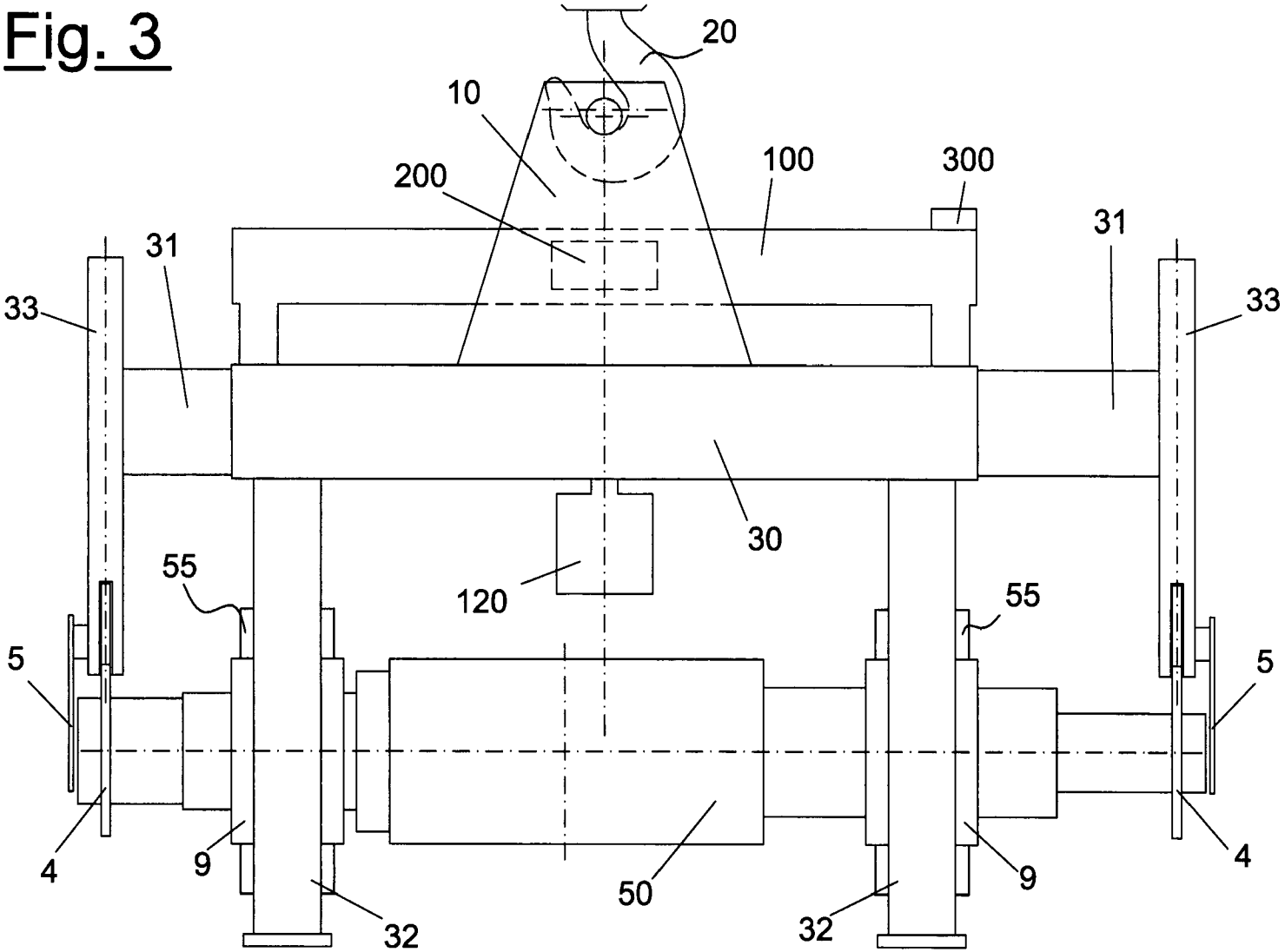
Figure 3A:
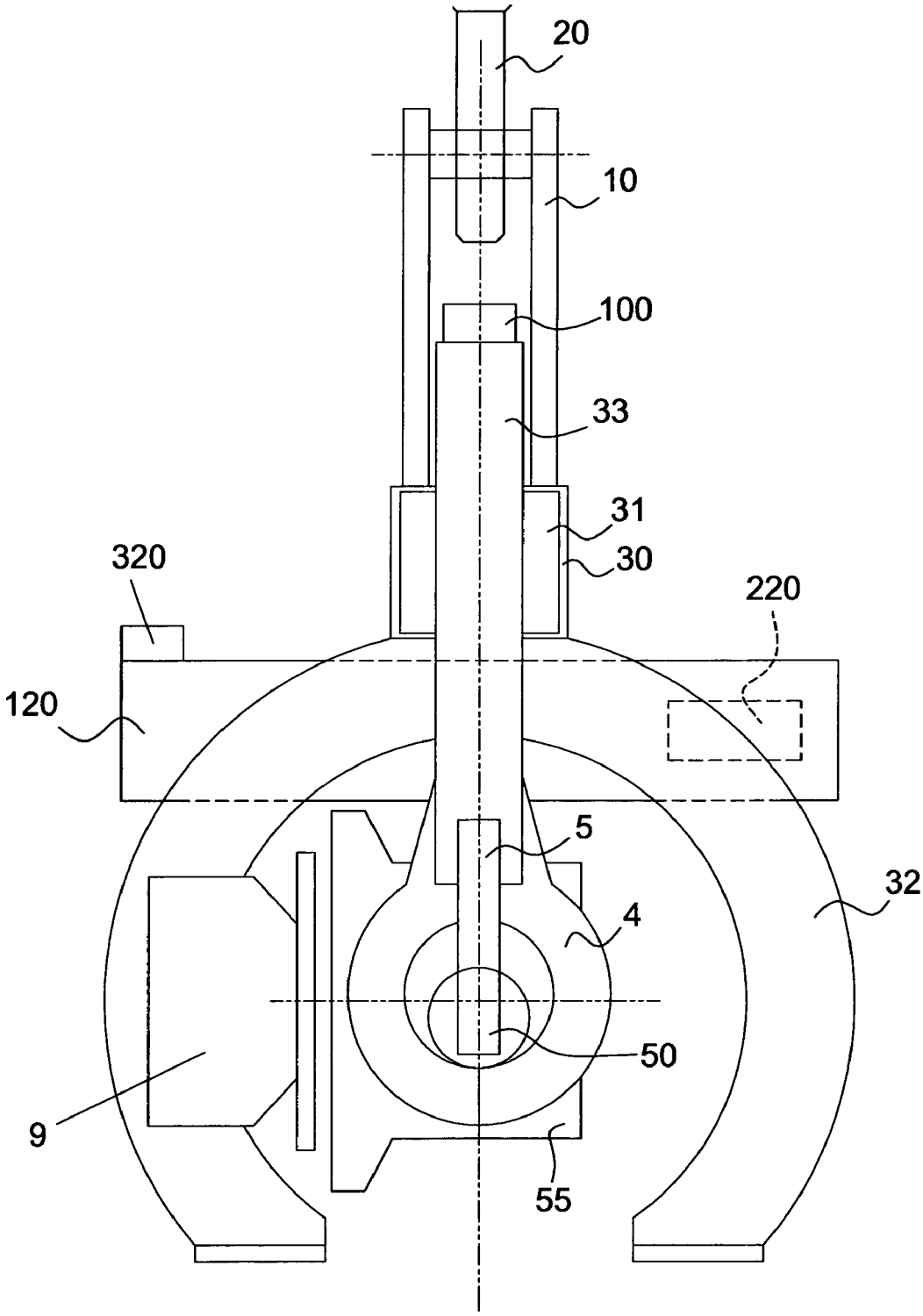

FIG. 2*a* shows a transversal side view of a hooking device for moving systems of rolling cylinders according to the present invention in an unloaded condition;

FIG. 3 shows a longitudinal side view of a hooking device for moving systems of rolling cylinders according to the present invention under loading conditions;

FIG. 3*a* shows a transversal side view of a hooking device for moving systems of rolling cylinders according to the present invention under loading conditions.

With reference to the drawings, the hooking device 1—or balance 1—for the moving systems of rolling cylinders in question is indicated as a whole with 1, and in the example illustrated, according to the present invention, comprises a cylinder-holder structure consisting of a fixed crossbar 30, to which a pair of telescopic cross-bars 31 is connected, wherein a pair of rotation devices 32 of the trimmings 55 and a pair of devices 33 suitable for lifting the gripping clamps 4 of the cylinder 50 are respectively connected to the crossbars 30, 31.

As in the case of the known devices, also in the hooking devices 1 according to the invention, a hooking structure 10 to the crane 20 is also connected to the structure 30-33. Furthermore, the lifting devices 33 of the grippers 4 are equipped with side stops 5, whereas the rotation devices 32 of the trimmings 55 each comprise an entrainment trolley 9 of the same.

In the hooking device 1 according to the invention, the correction of the two tilt angles is effected by means of two longitudinal sliding guides 100 suitable for contrasting the pitching, and two transversal sliding guides 120, suitable for contrasting the rolling, balancing masses 200, 220 being moved on said guides 100, 120 by means of a control device 300, 320 in order to obtain the equilibrium of the cylinder 50.

The correction of both tiltings is therefore obtained by the specific shifting of the balancing masses 200, 220 inside the structure of the balance 1 along the respective guides 100, 120.

The device according to the invention is therefore capable of also effectively compensating tiltings present along the transversal axis of the balance 1.

In the particular preferred but non-exclusive embodiment illustrated, the pairs of sliding guides 100, 120 are arranged along two directions orthogonal to each other. There is no restriction however for selecting non-orthogonal directions or using a greater number of guides having different orientations.

Furthermore, the moving of the masses 200, 220 along the guides 100, 120 of the balance 1 in no way modifies the relative positioning between the cylinder 50 and the supporting hook 20, allowing an exact positioning of the cylinder 50 in relation to the supports and hooks of the machine to which they are destined.

The balancing masses 200, 220 normally have reduced dimensions, and consequently do not increase the combined encumbrance dimensions of the balance 1 and cylinder 50.

It is sufficient, moreover, for the balancing masses 200, 220 to have a weight equal to about 2% of the overall weight of the balance 1 and cylinder 50 together, in order to already obtain the maximum efficiency for the inclination recovery.

In a simulated application during the project phase, it was demonstrated that the mass sufficient for contrasting an inclination of 2° in the pitching direction for a structural weight of 15 Tons and a cylinder of 30 Tons is only 500 kg.

The control device 300, 320 which also pilots these masses 200, 220 can therefore have reduced dimensions, i.e. so as to supply a much lower power with respect to the known devices which had to pilot the moving of the whole structure 30-33 including the cylinder 50.

A further advantage relating to the fact that the masses 200, 220 which are moved for compensating the tiltings have drastic weight reductions, is the possibility of being able to move these masses 200, 220 rapidly, as the inertia of these small moving masses 200, 220 is negligible and efficiently contrasts the natural oscillations of a greater entity induced in the system. This enables the system to be geometrically balanced without introducing further oscillation sources but, on the contrary, effectively contrasting the pitching and rolling oscillations possibly already present.

The positioning velocity of the balancing masses 200, 220 which can be reached, allows a balancing to be effected contemporaneously with the rotation systems of the trimmings 55, eliminating possible oscillations or static translations right from the beginning and reducing the overall moving times of the rolling cylinders 50.

The moving system using the hooking device 1 according to the invention can be adopted for all types of cylinder. If, in fact, new rolling installations envisage cylinders 50 exceeding the project limits of the original balance 1, the adjustment interventions to the balancing device are particularly rapid and not onerous as it is sufficient to substitute the balancing masses 200, 220 or add weights to said masses.

Said device 1 also offers the advantage of a high maneuvering safety and consequently also for the operators present in the area: the moving of the small balancing masses 200, 220, taking place inside the guides 100, 120 of the balance 1, substantially does not represent any danger as the large masses represented by the cylinder 50 and the balance 1 itself remain at a standstill during the compensation operation.

With the solution described herein using limited moving masses 200, 220 and the velocity in question, the device 1 according to the invention does not require greater maintenance operations with respect to the known fixed balances.

Figure 1:
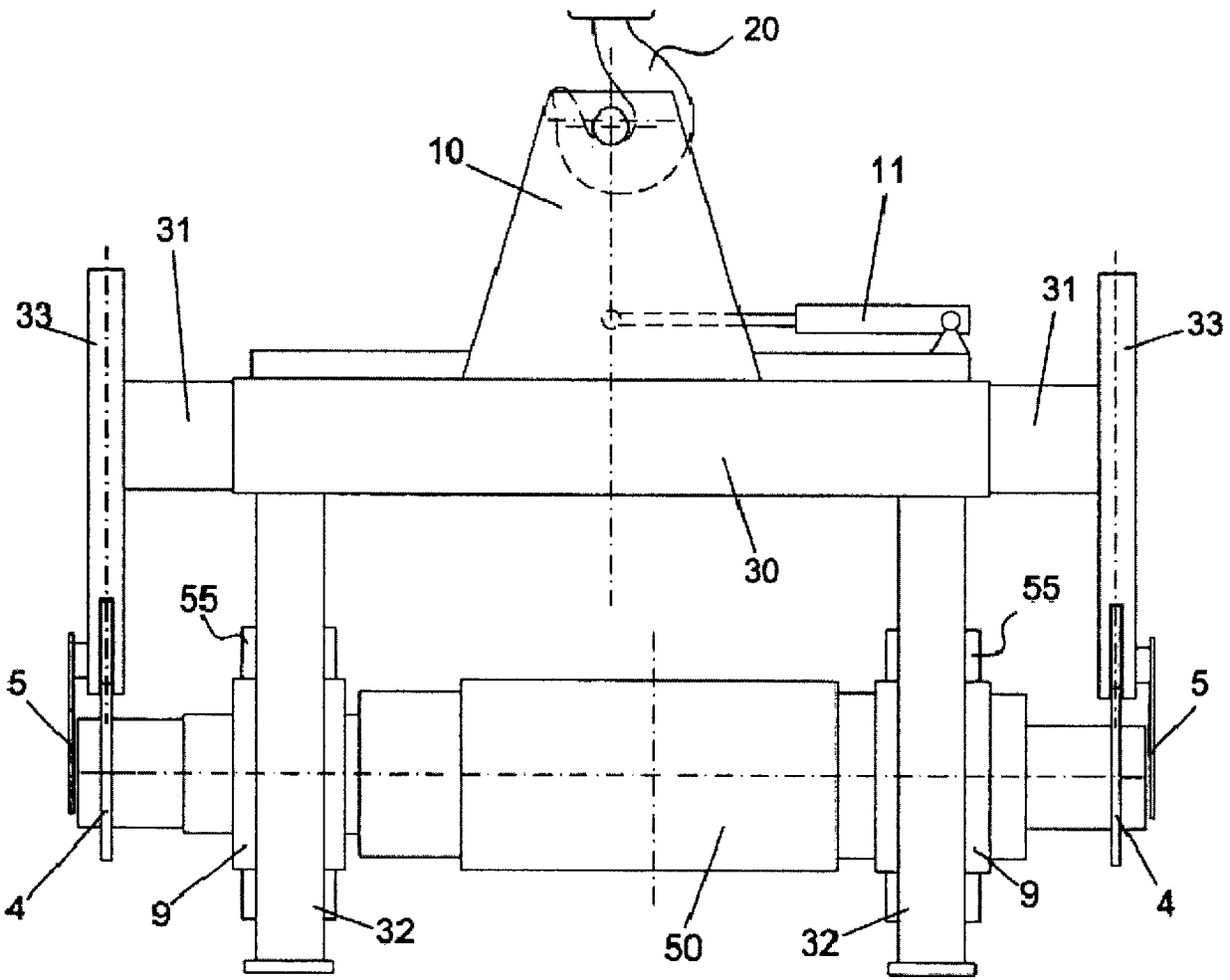
FIG. 1 shows a longitudinal side view of a hooking device for moving systems of rolling cylinders according to the known art under loading conditions.

With respect, on the other hand, to solutions with a varying geometry, such as that illustrated in FIG. 1, currently present on the market, there is a distinct improvement both in terms of moving times of the cylinders and also in terms of purchase and ordinary and extraordinary maintenance costs, these costs directly depend on the complexity of the device 1 itself and the necessary power to be supplied.

A drastic reduction in this power therefore implies an improved competitiveness in terms of direct and indirect costs necessary for the overall plant.

The moving systems of the masses 200, 220 can also be easily governed with automatic control systems inserted in the machine controller. In an automated system, veering sensors 400, 402 (as shown in FIGS. 2 and 2*a*), aligned along the directions of the main axes of the system provide the necessary information for allowing the configuration tiltings of the balance 1 to be corrected.

With the addition therefore of an adequate sensor network, the moving system of rolling cylinders using the hooking device according to the invention could easily be independent of any human intervention, as, in its interior, it has the capacity of reacting to any predicted possibility of unbalancing in addition to the qualities of precision, reliability and reproducibility necessary for effecting automated transportation in any Roll Shop.

From what is described above with reference to the figures, it is evident how a hooking device for moving systems of rolling cylinders according to the invention is particularly useful and advantageous. The objective mentioned in the preamble of the description is therefore achieved.

The device does in fact allow both longitudinal and transversal tiltings to be compensated, also obtaining a damping of the pitching oscillations and oscillations due to rolling, without the necessity of a high piloting power.

Furthermore, the hooking device according to the invention offers a high precision and certainty with respect to the positioning of the cylinder and consequently the possibility of using a remote and possibly automatic control of the moving system of rolling cylinders.

The forms of the hooking device according to the invention, as also the materials, can naturally differ from that shown for non-limiting illustrative purposes in the drawings. The arrangement and number of guides, for example, can vary according to implementary requirements.

The protection scope of the invention is therefore delimited by the enclosed claims.

The invention claimed is:

1. A hooking device for moving systems of rolling cylinders comprising:

a load-bearing lifting structure of a cylinder provided with grippers for said cylinder and an upper hooking structure to keep said hooking device in a raised position; and a tilt compensating mechanism including first and second non-load bearing guides fixed to said lifting structure, said guides each provided with at least one balancing mass element which is moveable along said respective guide, and said guides extending in different directions of a horizontal plane of said hooking device.

2. The hooking device for moving systems of rolling cylinders according to claim 1, wherein said first guide is parallel to a longitudinal extension of said hooking device and said second guide is orthogonal to said first guide.

3. The hooking device for moving systems of rolling cylinders according to claim 1 or 2, wherein said balancing mass elements are movable along said first and second guides by means of respective control devices.

4. The hooking device for moving systems of rolling cylinders according to claim 3, wherein said control devices of said balancing mass elements are connected to a series of sensors suitable for determining longitudinal and/or transversal tilting of said cylinder.

5. The hooking device for moving systems of rolling cylinders according to claim 4, wherein said control devices are automated to balance said cylinder based on said longitudinal and/or transversal tilting by moving said balancing mass elements.

6. The hooking device for moving systems of rolling cylinders according to claim 4, wherein said control devices are remotely controlled.

7. The hooking device for moving systems of rolling cylinders according to claim 1, wherein said tilt compensation mechanism has a substantially limited encumbrance in an encumbrance volume occupied by said lifting structure.

8. The hooking device for moving systems of rolling cylinders according to claim 1, wherein said balancing mass elements have a weight substantially equal to 2% of an overall weight of said hooking device loaded with said cylinder.

9. The hooking device for moving systems of rolling cylinders according to claim 1, wherein said balancing mass elements can be removed from said guides.

10. The hooking device for moving systems of rolling cylinders according to claim 1, wherein said lifting structure comprises a fixed crossbar, to which a pair of telescopic crossbars are connected, and a pair of devices suitable for piloting in rotation a series of trimmings present on said cylinder, and a pair of devices suitable for lifting a series of gripping clamps of said cylinder are respectively connected to the telescopic crossbars.

11. The hooking device for moving systems of rolling cylinders according to claim 10, wherein:

said first guide is parallel to said fixed crossbar, and said second guide is orthogonal to said fixed crossbar.

12. The hooking device for moving systems of rolling cylinders according to claim 11, wherein said first and second guides are fixed to said fixed crossbar.

13. The hooking device for moving systems of rolling cylinders according to claim 12, wherein said upper hooking structure is fixed to said fixed crossbar.

14. The hooking device for moving systems of rolling cylinders according to claim 1, further comprising:

a fixed crossbar to which said first and second guides are fixed, wherein said upper hooking structure is fixed to said fixed crossbar.

15. The hooking device for moving systems of rolling cylinders according to claim 1, wherein the guides are respectively arranged to control, by movement of the balancing mass elements, pitch and roll movements of the hooking device.

16. The hooking device for moving systems of rolling cylinders according to claim 1, wherein a geometry of the load-bearing lifting structure, including the grippers for said cylinder and the upper hooking structure, is maintained during the movement of the balancing mass elements.

* * * * *